US010697222B2

(12) United States Patent
Milnes et al.

(10) Patent No.: US 10,697,222 B2
(45) Date of Patent: Jun. 30, 2020

(54) DOOR MECHANISM THAT PERMITS EASY OPENING AND HOLDS DOOR OPEN

(71) Applicants: Iain Milnes, Fremont, CA (US); Agile Johns, San Jose, CA (US)

(72) Inventors: Iain Milnes, Fremont, CA (US); Agile Johns, San Jose, CA (US)

(73) Assignee: Power Knot, Inc., Fremont, CA (US)

( * ) Notice: Subject to any disclaimer, the term of this patent is extended or adjusted under 35 U.S.C. 154(b) by 256 days.

(21) Appl. No.: 15/810,047

(22) Filed: Nov. 11, 2017

(65) Prior Publication Data

US 2019/0145143 A1 May 16, 2019

(51) Int. Cl.

| | |
|---|---|
| ***E05F 3/20*** | (2006.01) |
| ***E05F 1/10*** | (2006.01) |
| ***E05D 11/08*** | (2006.01) |
| *B65F 1/16* | (2006.01) |

(52) U.S. Cl.

CPC ..... *E05F 3/20* (2013.01); *E05D 11/087* (2013.01); *E05F 1/10* (2013.01); *B65F 1/1646* (2013.01); *E05Y 2900/602* (2013.01)

(58) Field of Classification Search

CPC .. E05F 3/20; E05F 1/10; E05D 11/087; B65F 1/1646; B65F 1/1623

USPC ..... 16/286, 287, 288, 289, 291, 293, 319

See application file for complete search history.

(56) References Cited

U.S. PATENT DOCUMENTS

| | | | | |
|---|---|---|---|---|
| 4,679,841 | A * | 7/1987 | Taunay | E05D 3/06 16/288 |
| 5,544,388 | A * | 8/1996 | Chiura | E05D 3/145 16/375 |
| 7,673,929 | B2 * | 3/2010 | Patzer | E05F 3/14 296/146.11 |
| 7,797,796 | B2 * | 9/2010 | Migli | E05D 15/46 16/286 |
| 7,798,541 | B2 * | 9/2010 | Hirtsiefer | E05C 17/345 292/262 |
| 8,991,010 | B2 * | 3/2015 | Brunnmayr | E05F 5/006 16/319 |
| 9,316,036 | B2 * | 4/2016 | Collene | E05F 5/10 |
| 10,025,259 | B2 * | 7/2018 | Doi | G03G 21/1633 |
| 10,041,283 | B2 * | 8/2018 | Zetti | E05D 3/16 |
| 2006/0070210 | A1 * | 4/2006 | Amdahl | F16M 11/10 16/288 |
| 2008/0197651 | A1 * | 8/2008 | Stratten | B62D 33/0273 296/50 |
| 2018/0298661 | A1 * | 10/2018 | Salice | E05D 15/401 |
| 2019/0309554 | A1 * | 10/2019 | Scharer | E05F 1/12 |
| 2019/0323276 | A1 * | 10/2019 | Vanini | E05F 3/20 |

(Continued)

*Primary Examiner* — Jeffrey O'Brien

(74) *Attorney, Agent, or Firm* — Patent Law Office www.patentoffice.io; Bao Tran

(57) ABSTRACT

A door support includes a first shaft coupled to a door for rotating the door; a first armature on the first shaft; a second shaft with at least one module that resists motion; a second armature on the second shaft; a linkage that connects the armature on the first shaft with the armature on the second shaft; a freewheel on the second armature or on the second shaft that does not engage the module that resists motion thereby allowing the door to open without resistance, the freewheel engaging as the door is closed to provide a resistance as the door is closed, and the linkage positioned such that as the door is nearly closed that the resistance becomes negligible allowing the door to fully close.

7 Claims, 18 Drawing Sheets

(56) References Cited

U.S. PATENT DOCUMENTS

2019/0353353 A1* 11/2019 White ..... E05F 5/02
2019/0383081 A1* 12/2019 Thielmann ..... E05D 3/16

* cited by examiner

FIG. 1 (PRIOR ART)
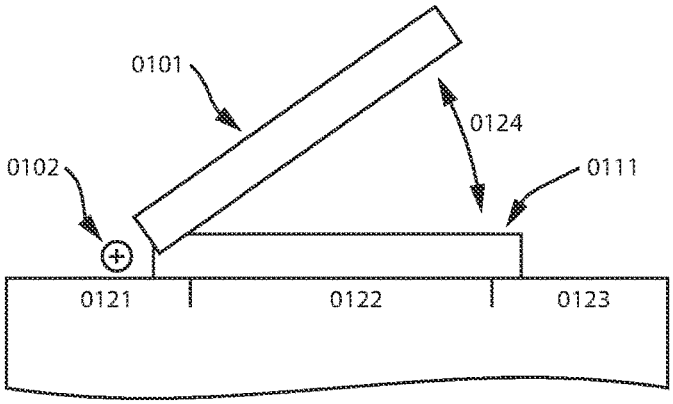
FIG. 1A
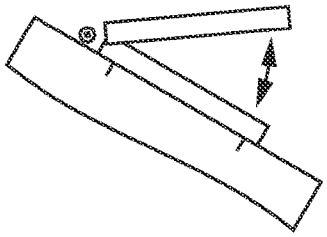
FIG. 1B
FIG. 1C
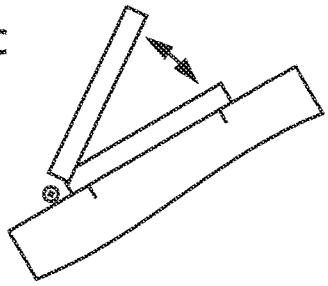
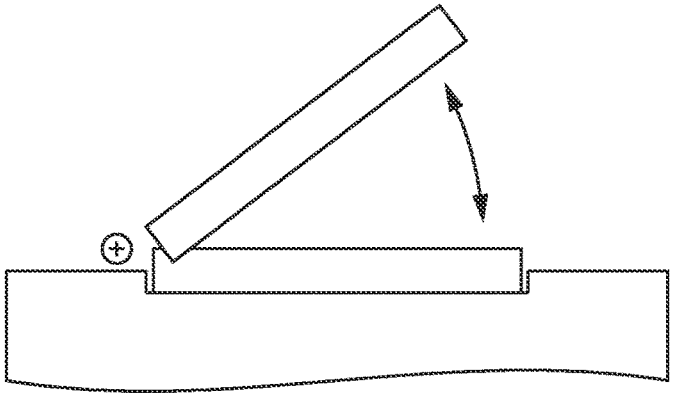
FIG. 1D
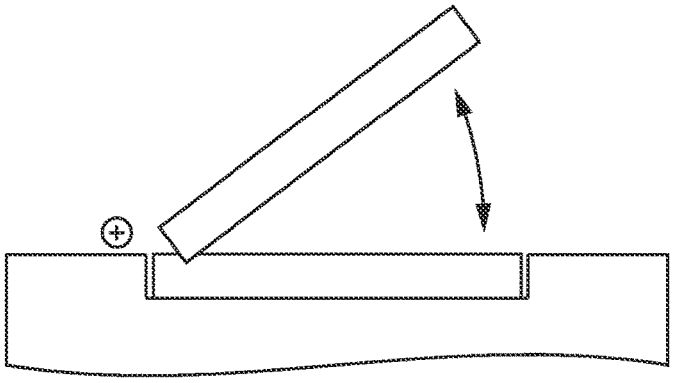
FIG. 1E FIG. 7 (PRIOR ART)
FIG. 7A
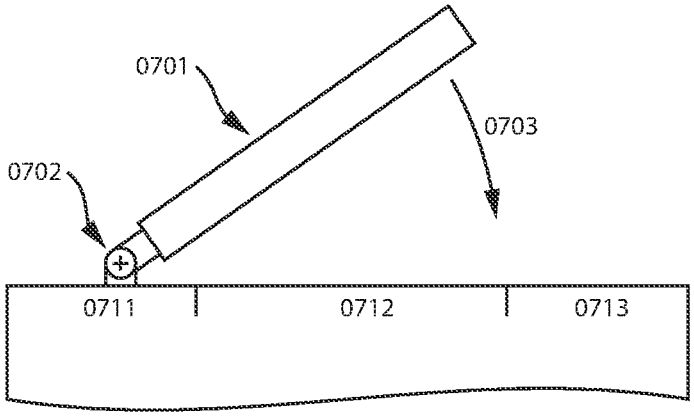
FIG. 7B
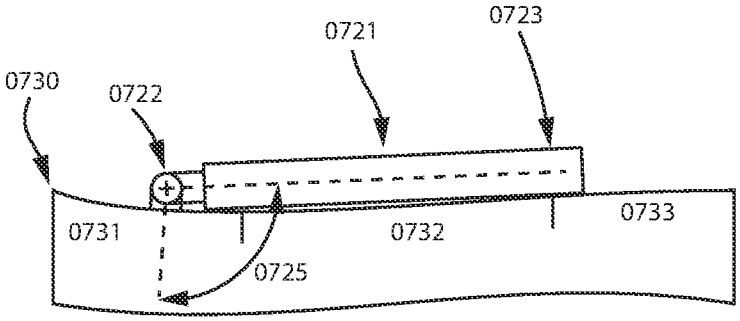
FIG. 7C
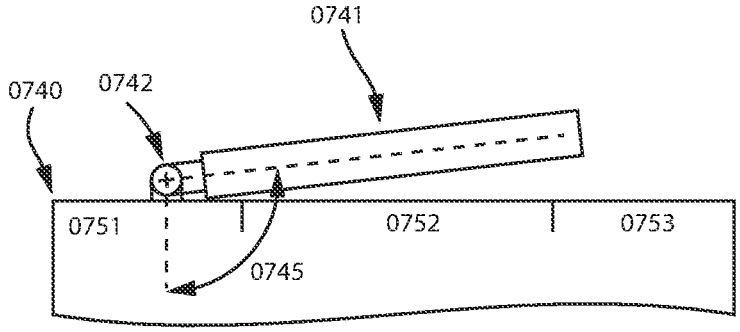

FIG. 8
FIG. 8A
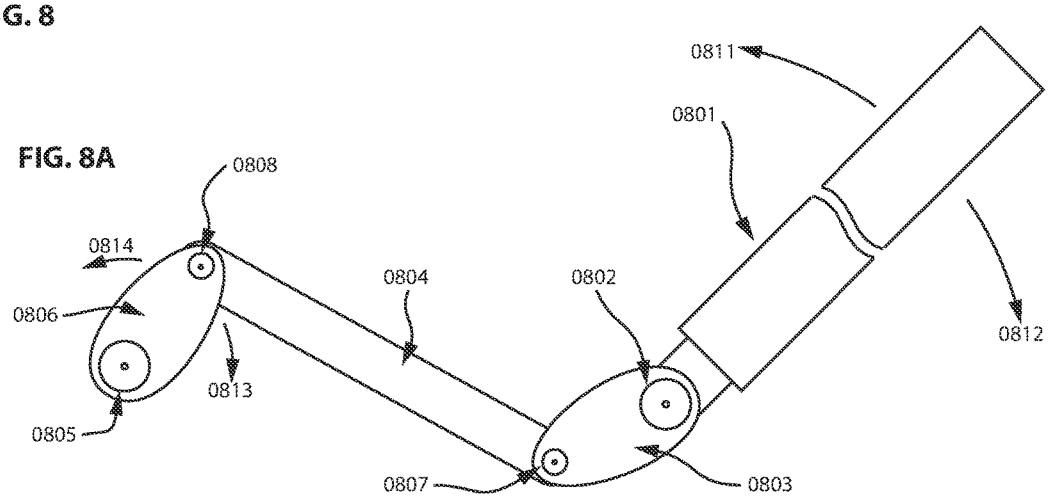
FIG . 8B
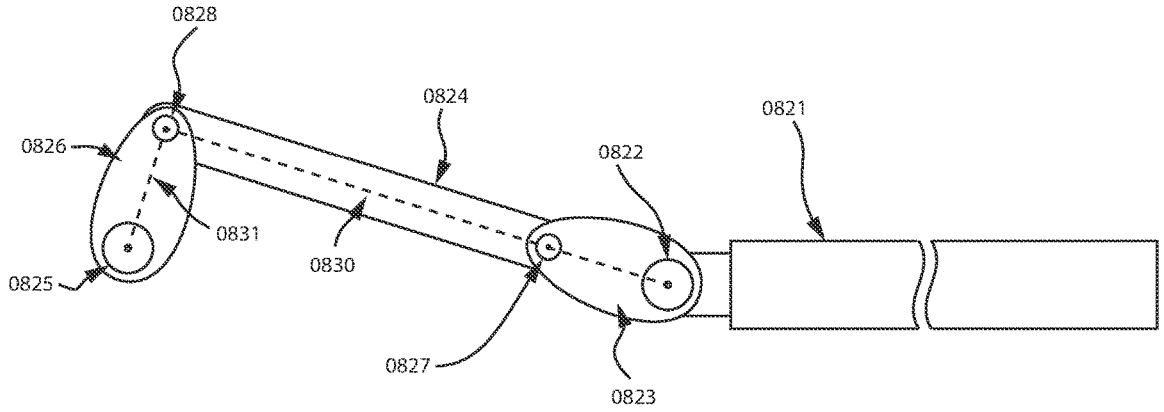
FIG. 9
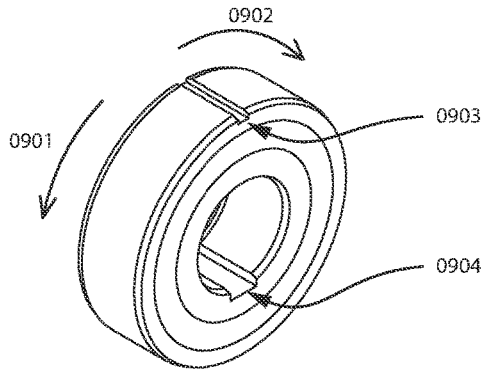

FIG. 14
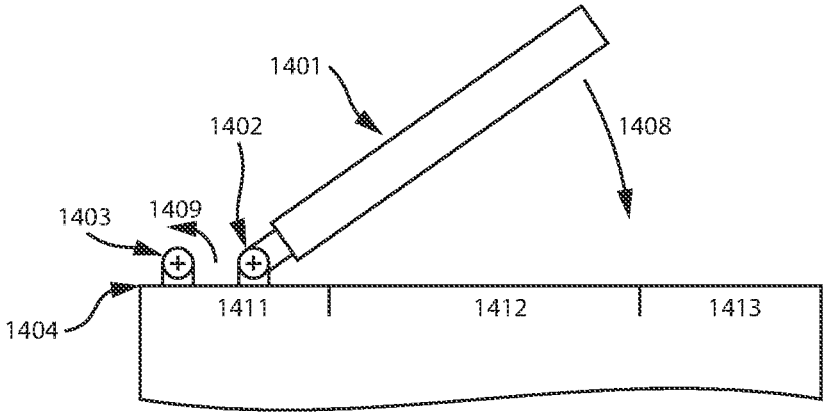
FIG. 14A
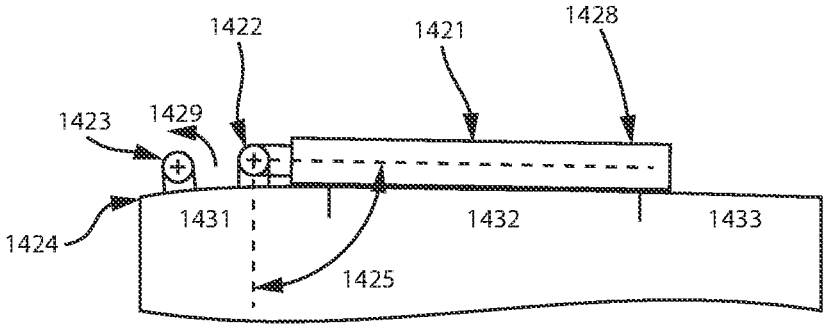
FIG. 14B
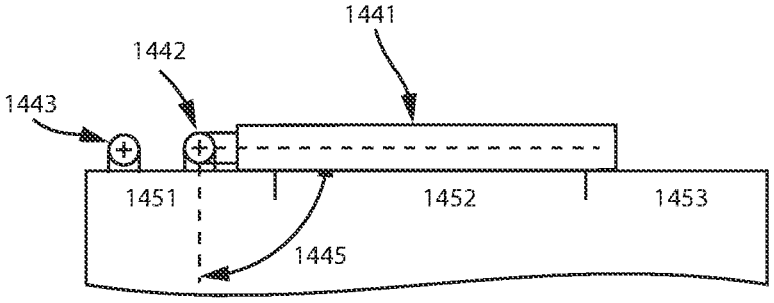
FIG. 14C

DOOR MECHANISM THAT PERMITS EASY OPENING AND HOLDS DOOR OPEN

The present invention relates to a door opening and closing system.

BACKGROUND

In many applications, a door is used to secure access to a confined storage space. Hence forth, any door, lid, or cover is hereafter referred to as a door. In certain applications, the door acts as a seal isolating the storage space from the environment. In these applications, a heavy door is used as a structural reinforcement and also as a natural barrier. It is also particularly beneficial where cleanliness is a concern. Some examples are shown in FIG. 1A-1E.

In FIG. 1A the door 0101 is horizontal when closed indicated by position 0111. A handle is not shown on this or most of the other figures as it is immaterial to the current invention. The door is hinged or pivoted about point 0102. The method of fixing the hinge to the door is not shown and is immaterial to the current invention. Also, the position of point 0102 relative to the door is not identified as it too is immaterial to the present invention. The door 0111 when closed sits on a top panel 0121, 0122, and 0123. The position 0122 is an opening in the panel that is revealed when the door is opened.

Often it is required for the door to remain closed under its own weight if there are no external forces. Thus, the present invention applies when the door, when closed, is:

horizontal as shown in FIG. 1A, slopes down as shown in FIG. 1B slopes up as shown in FIG. 1C The present invention applies when the door, when closed, is:

sitting on the top panel as shown in FIG. 1A partially recessed from the top panel as shown in FIG. 1D recessed from the top panel as shown in FIG. 1E In all subsequent figures, it is assumed that the door is shown as horizontal when closed and sitting on top of the panel as indicated in FIG. 1A. Further, it is assumed that the ideal opening for the door is 90°, but the present invention applies to any degree of opening that is reasonable to permit access to the opening. The subsequent FIG.s and descriptions use these two assumptions for brevity but this must not be construed to restricting the applicability of the present invention.

The typical way to accomplish the objective is with one or two gas struts as shown in FIG. 2. The door 0201 pivots at one or more hinges 0202 and is accessed by handle 0203. The gas strut 0204 is selected so that once the door is open past position 0205 that the force of the gas strut will continue to open the door until the strut has reached its end stop. The opening 0206 is now accessible.

To close the door, the operator pulls against the force of the gas strut; the weight of the door helps the user. As the door closes, the weight of the door overcomes the force of the gas strut and the door closes fully. This approach has worked well for years, but has several disadvantages:

the gas strut is in the way of the opening exposed by the door the fasteners used for mounting gas struts may loosen over a period of time requiring extra maintenance it is difficult to keep the fitting for the gas strut and fasteners completely clean the gas strut and fasteners may come in contact with the working environment which may become hazardous for the operation; for example, if the machines are used in food processing or pharmaceutical manufacturing Alternative methods can use a special hinge. There are two main types of special hinges: the torque hinge and the self-closing hinge.

For a torque hinge, this provides a constant torque in the opening direction and a constant torque in the closing direction. These two torque values may be the same or different (resulting in an asymmetric torque hinge). The asymmetric torque hinge may be preferred. It is shown in FIG. 3. The door 0301 has one or more hinges 0302. This type of hinge usually requires that it is mounted flush with the upper surface of the door so the hinges are supported by block 0303. The door covers the opening 0306.

The characteristics of the hinge are shown in FIG. 4. The FIG. shows the torque of the hinge from 0° (closed) to 90° (fully open) and back again. Along path 0401 the torque is low as the door is opened. When the door is open the path 0402 shows a higher torque required to close the door. The torque required to keep the door open (shown as 0403) is proportional to cos(ø) where ø is the angle of opening (assuming the door is horizontal when closed). This curve reflects the distance of the center of mass of the door from the hinge point.

Where the line 0403 intersects line 0402 indicates the angle at which the door will be held by the hinge (to the right of the intersection) or where it will fall under its own weight (to the left of the intersection). This point is marked as 0404 on FIG. 4 and it is reasonably desired that this angle is about 30°.

This type of hinge allows the user to easily open the door. The low torque 0401 in FIG. 4 is shown as 0304 in FIG. 3. The higher closing torque of 0402 in FIG. 4 is shown in means that the door will stay open. When the user closes the door, the weight of the door assists in overcoming the torque. There are three problems:

(i) The door, being heavy, is hard to open. The assistance of the gas strut that was used in FIG. 2 is missing. This can be overcome with the addition of one or more extension springs and there exist specific torque hinges on the market constructed like this. Alternatively, one or more separate extension springs 0307 can be positioned for example as shown in FIG. 3.

(ii) The torque hinge is resisting the closing of the door. [This is easily seen on the display of a laptop computer. When the display is open, if you move the end of the display just a few mm, it will return to its original position. Making the laptop display close completely is difficult and many earlier models would leave the display slightly open by a few mm.] With this type of hinge it is impossible to close the door completely and it will remain open a few mm. This can be overcome by the addition of a latch installed at the front of the door to hold the door closed. However, it is an objective of the present invention that a latch should not be present as this adds to the disadvantages of the current state of the art as described above.

(iii) As the door closes, the torque that the door presents on one side of the hinge results in a reactionary torque (equal and opposite) on the other side of the hinge. This results in a force pushing the hinge down and thereby rotating its mounting plate as the door is closed. This is shown in FIG. 7 which is a side view.

(iii)(a) In FIG. 7A, the hinge 0702 is connected to the door 0701. The hinge is mounted on the top panel 0711, 0712, and 0713. The part 0712 is the opening that the door 0701 covers. The door is closed in the direction 0703.

(iii)(b) FIG. 7B shows what happens as the door is closed. The force 0723 on door 0721 results in a torque 0722 about the back of the panel 0730. The top panel (0731, 0732, and 0733) deforms while force 0723 is applied. The door rests on the top panel, but the angle 0725 (representing the angle of the door from the vertical position) is greater than 90°.

(111)(c) FIG. 7C shows the effect after the force 0723 is removed. With the force 0723 removed, the top panel reverts to its original shape (as shown in FIG. 7A). The angle 0745 is identical to 0725 and this results in the door remaining partially open.

For the self-closing hinge, it presents minimal toque to open or close the door. It has a damper mechanism on closing so it allows the door to close on its own slowly. This hinge is commonly used on toilet seats. This type of hinge is installed the same way as the torque hinge shown as 0302 in FIG. 3. The torque characteristics are shown in FIG. 5. The hinge allows the user to easily open the door (low torque as indicated as 0501). The torque required to hold the door is shown as 0503 which intersects the line representing the closing torque (0502) close to the fully open position (90°). As soon as the door is moved from this position the door starts to close because its weight overcomes the torque of the hinge and the door closes. The damper in the hinge causes the door to close slowly.

There are two problems with this type of hinge:

(i) The hinge will not hold the door open at any angle. It must be opened nearly 90° or more to ensure it will not fall back to the closed position. This means that it requires a support to hold it just past the vertical point. The support structure is undesirable in most situations and it can be inconvenient to have to open the door so far.

(ii) Users may want to close the door themselves. They will try to overcome the damping force in the hinge. With current technology, the life of these hinges is about 10,000 cycles and forcing the door closed will reduce the life of the hinge.

It is apparent that the use of readily available technologies to solve the problem cannot be deployed.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown.

FIGS. 1A-1E show various exemplary door opening and closing positions.

FIGS. 7A-7C show door opening and closing positions according to the preferred embodiment.

FIGS. 8A-8B show exemplary side views of the preferred embodiment in a door open position and a door closed position, respectively.

FIG. 9 shows an exemplary one-way bearing.

FIGS. 14A-14C show exemplary effect of the torque mechanism rotating in the opposite direction to that of the door.

SUMMARY

Figure 2:
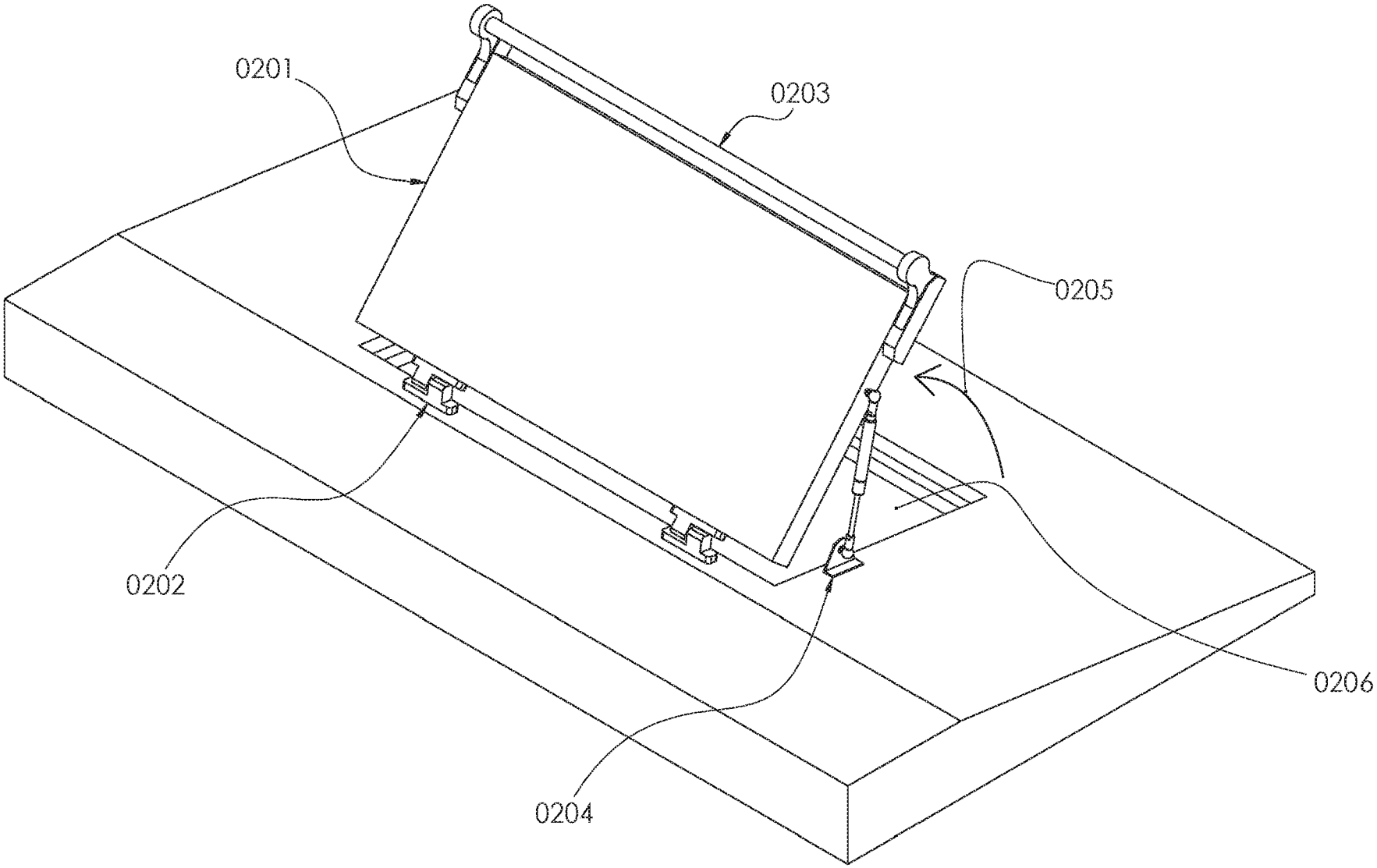
FIG. 2 (PRIOR ART)
FIGS. 2-3 show conventional door support systems.
Figure 3:
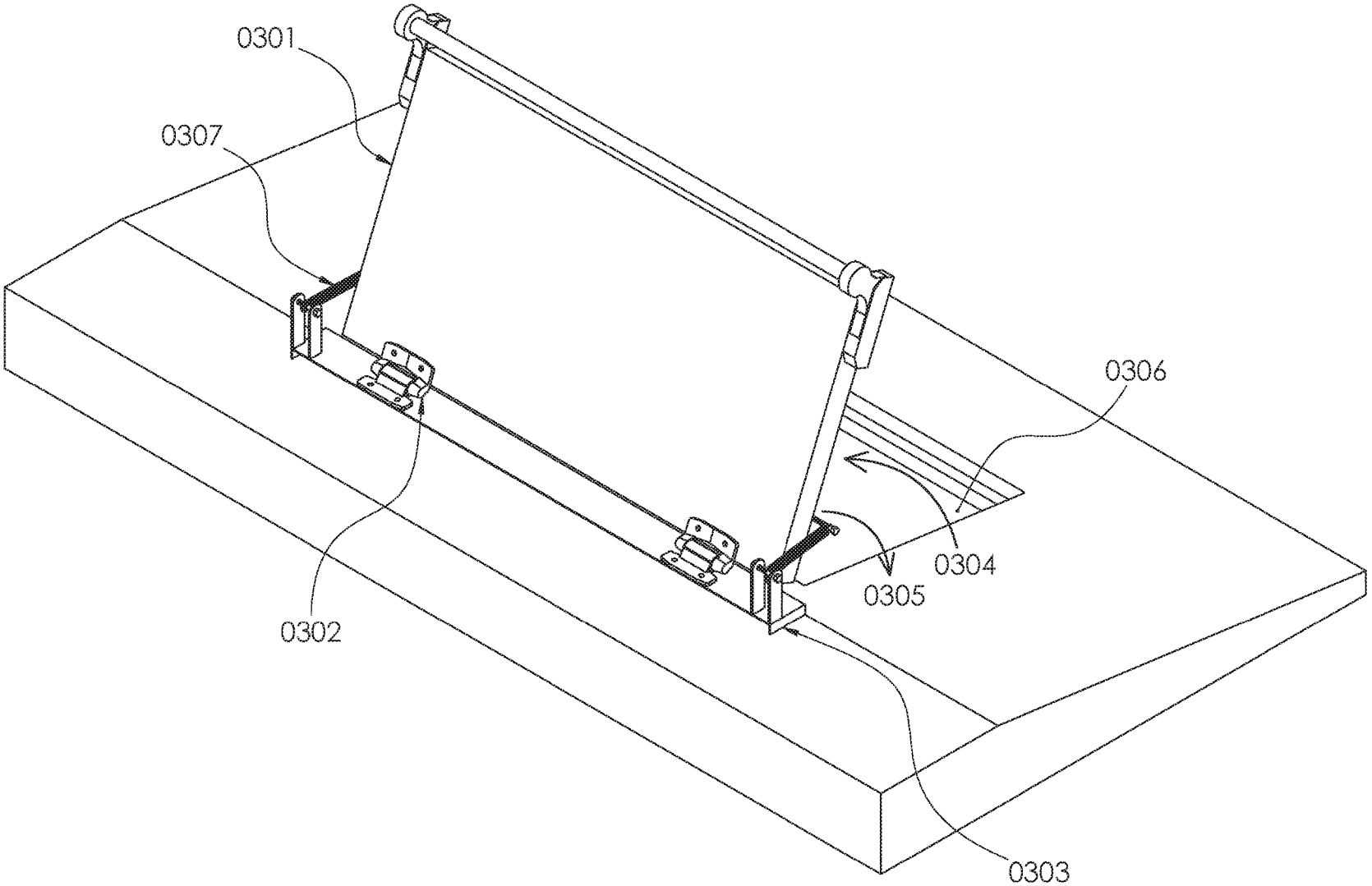
FIG. 3 (PRIOR ART)
Figure 4:
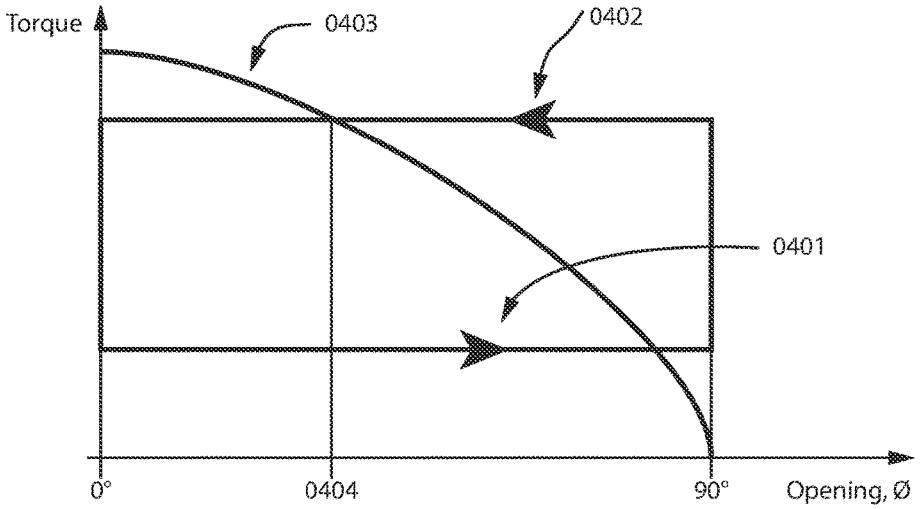
FIG. 4 (PRIOR ART)
FIGS. 4-5 show conventional door opening and closing sequences.
Figure 5:
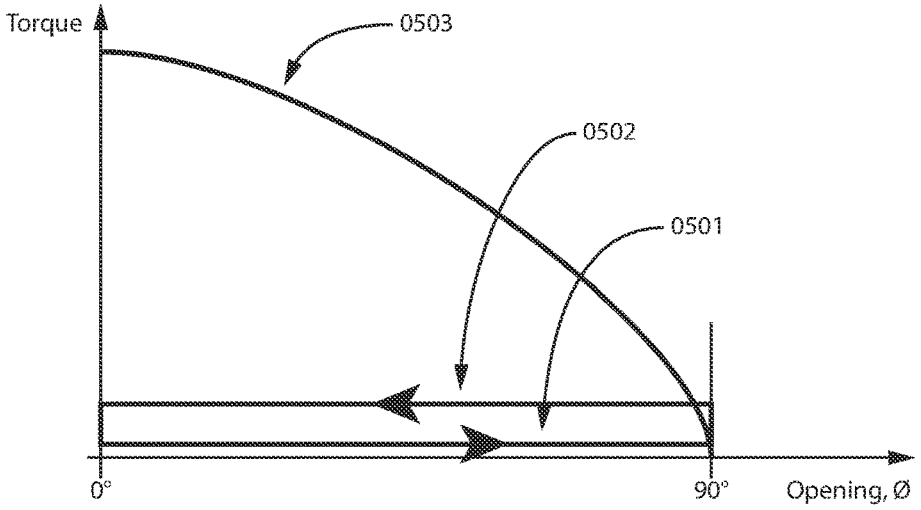
FIG. 5 (PRIOR ART)

A door support includes a first shaft coupled to the door for rotating a door; a first armature on the first shaft; a link module on the armature to enable the door to be fully closed without resistance; a second shaft with a motion-resistant module thereon; a second armature on the second shaft coupled to the link module, wherein as the first shaft rotates the second shaft rotates; and a freewheel on the second shaft and coupled to the motion-resistant module, wherein the freewheel enables door opening without resistance and door closing engages the motion resisting motion on the second shaft.

The preferred embodiment enables a relatively heavy door that may be opened easily by a person. The door remains in place while open and may be closed completely with minimal effort by a person. The door is hinged and that once opened, nothing impedes the access to the opening. Once the door is opened beyond a certain angle it can stay open without any supplemental devices being required. The mechanism should last at least 30,000 openings before requiring replacement of any part.

DETAILED DESCRIPTION

Certain terminology is used in the following description for convenience only and is not limiting. The words "top," "bottom," "inner," and "outer" designate directions in the drawings to which reference is made. The terminology includes the words specifically noted above, derivatives thereof, and words of similar import.

An easy to open door support includes:

- a shaft on which the door rotates
- an armature on this shaft that has a link mechanism
- a second shaft that has a mechanism that resists motion on it
- an armature on this second shaft that connects to the link mechanism so that as the door shaft rotates the second shaft rotates
- positioning the link mechanism so that when the door is closed there appears no resistance to the door closing fully
- a freewheel mechanism on the second shaft so that as the door is opened there is no resistance to motion and as the door is closed the mechanism resisting motion on this second shaft is engaged.

Figure 6:
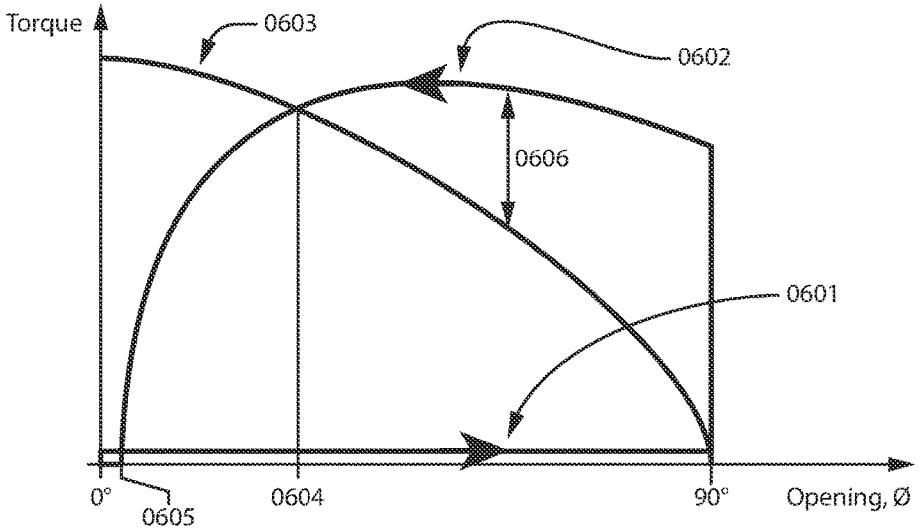
FIG. 6 shows door opening and closing sequences according to the preferred embodiment.

The door hinge support mechanism is shown in more details in FIG. 6. As the door opens (moves from 0° to 90°) the hinge presents little or no torque identified as 0601. As the door closes, it presents the torque shown as 0602. The torque presented by the mass of the door is shown as 0603, where 0603 is proportional to cos(ø) and ø is the angle of opening. Where 0602 and 0603 intersect is the angle at which the door is held open. This point is shown as 0604 and is desirable to be at about 35° for practical purposes. The door will remain open at angles greater than 0604 (to the right of the line on the graph) and will close on its own at angles less than 0604 (to the left of the line on the graph).

As the door closes, the hinge mechanism should present increasingly less torque until point 0605 where it presents zero torque. This point 0605 is not at 0° but it at about 5° to ensure there is no resistance to the door fully closing.

The curved shape of line 0602 mimics somewhat that of 0603 so that the torque that the operator must apply to close the door (shown as 0606) is reasonably large until the door is closed at a certain point (perhaps 45°). This will help to prevent the operator from accidentally knocking the door and the door closing itself when that was not desired.

A. Operation Description

A.1. Basic Principle

The basic principle is shown in FIG. 8 which is a side view. In FIG. 8A, the door 0801 is fixed to and rotates about a shaft or hinge point 0802. That is, as the door rotates, the shaft rotates. The shaft is supported by bearings or bushes (that are not shown) to allow it to rotate freely.

An armature 0803 also fixed to the shaft and rotates as the shaft rotates (and therefore as the door opens). The shaft 0802 does not need to rotate, but the armature 0803 must rotate in concert with the door 0801. The armature 0803 may be fixed directly to the door 0801 or to a hinge that itself is fixed to door 0801. However, fitting these items on a shaft that itself rotates is the easiest and simplest way of accomplishing the preferred embodiment.

A second shaft 0805 has the torque mechanism (not shown). This shaft has an armature 0806 which rotates about shaft 0805. The armature 0806 is connected to armature 0803 by link 0804. Link 0804 has holes 0807 and 0808 which have bolts or some other pivot points to fix it to the armatures 0803 and 0806.

As the door opens (in direction 0811) armature 0803 rotates in the same direction (as shown, anti-clockwise) and armature 0806 rotates in the opposite direction 0813 (as shown, clockwise). As the door closes (direction 0812) armature 0803 rotates clockwise and armature 0806 rotates anti-clockwise (direction 0814).

It is possible to arrange the preferred embodiment so that the armatures 803 and 806 always rotate in the same direction. However, as explained below, there are advantages to having the shafts rotate in opposite directions.

The torque mechanism (comprising shaft 0805 and armature 0806 and other parts as described below) provides no resistance when rotating clockwise (direction 0813) and provides resistance when rotating anti-clockwise (direction 0814).

Therefore there is no resistance to the door being opened but there is resistance to the door closing.

A.2 Achieving No Resistance Close to Zero Degrees

The objective as described above is that there should be no resistance presented to fully closing the door. The solution in the preferred embodiment is shown in FIG. 8B.

The door 0821 is shown in the closed position. The door 0821 is fixed to shaft 0822 as is the armature 0823.

The link 0824 is connected to armature 0823 at point 0827 and to armature 0826 at point 0828. Armature 0826 rotates about shaft 0825 which has the torque mechanism.

When the door 0821 is closed, the center points of shaft 0822, connector 0827, and connector 0828 are in line as shown by line 0830. A small movement of the door (opening 5°) causes little or no movement in link 0824. Therefore, there is little or no movement in armature 0826 and consequently, little or no movement in torque shaft 0825. Therefore, as the door closes, the resistance that was acting against the door being closed collapses to zero. This allows the door to close fully under its own weight without resistance or obstruction from the torque mechanism.

In practice, perfect alignment of 0822, 0827, and 0828 as indicated by line 0830 is not required, and there can be a misalignment of ±2° before the door may not close fully.

To further improve the closing, armature 0826 is positioned such that it is perpendicular to link 0824 when the door is closed. Thus the line 0831 which passes through the center of 0825 and 0828 is at 90° to line 0830. The effect of this condition is significantly smaller than the effect described above by aligning the armature 0823 and link 0824.

A.3 Explanation of Torque Mechanism

The major components are a freewheel mechanism and a friction or damping mechanism. There are many ways of using these to implement the preferred embodiment. These components can be implemented with products that are readily available or with custom made components. Damping mechanisms are readily available and can be easily fixed to the end of the shaft 0805 in FIG. 8.

Friction mechanisms with sufficient torque capability are harder to locate as standard products and two examples are described below.

The freewheel mechanism is easily found as a standard part that can use a ratchet, balls, or sprags. Devices using sprags are often called sprag clutches, sprag bearings, or one way bearings. A one way bearing is shown in FIG. 9; these are commonly available commercial products. In the examples below, the one way bearing is shown, but this does not preclude the use of any other type of freewheel mechanism.

In FIG. 9, the bearing may freely rotate in one direction 0901 but is latched or engaged in the opposite direction 0902. The bearing has a notch 0904 to hold the bearing onto a shaft and a notch 0903 to retain the bearing in a housing or armature. When the bearing is installed in a housing, the outer part of the bearing is fixed and the shaft can rotate in one direction but not in the other direction. When the bearing is fitted in an armature, and the shaft is fixed, the outer part of the bearing can rotate in one direction but not the other.

A.3.i First Method: Using Friction Mechanism Created by Shaft Turning

Figure 10:
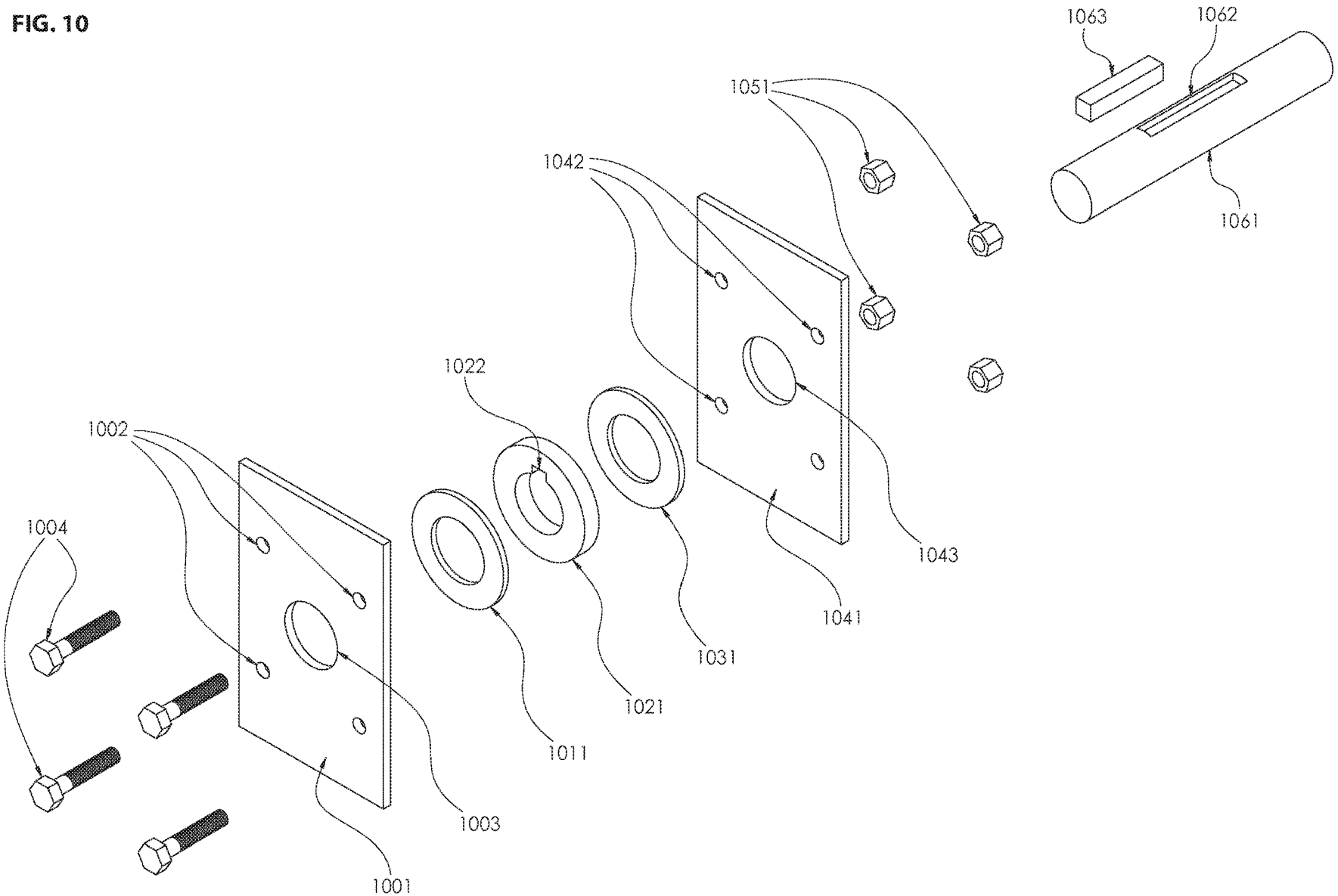
FIGS. 10-11 show exemplary friction generation through shaft turning.

The friction mechanism is implemented as shown in FIG. 10. The plate 1001 is fixed. The method of fixing is not shown in FIG. 10 but it may be welded, bolted, or clamped in place. The holes 1002 allow bolts 1004 to pass through. There may be any number of bolts, though in practice three to eight may be used. The plate 1001 also has a larger hole 1003 through which shaft 1061 will fit easily.

The bolts 1004 connect to plate 1041 by passing through holes 1042. Nuts 1051 fit over bolts 1004. There may be washers and secondary nuts used as lock nuts but these are immaterial to the operation of the preferred embodiment.

Plate 1041 is therefore fixed to plate 1001 so that it cannot rotate. It is called a floating plate.

Between plates 1001 and 1041 are three washers 1011, 1021, and 1031. Washers 1011 and 1031 would usually be made of the same material and can rotate about shaft 1061. Washer 1021 would be made of a hard material such as steel. It has a notch 1022.

When the shaft 1061 is in position, the key 1063 fits into notch 1062 and matches the notch 1022 on washer 1021. When the shaft 1061 rotates, washer 1022 rotates, but plates 1001 and 1041 do not rotate.

The bolts 1004 are fastened tightly with nuts 1051 so that as washer 1022 rotates it creates friction against the surfaces of washers 1011 and 1031. These washers 1011 and 1031 will also try to rotate and create friction against plates 1001 and 1041 respectively. This friction is created regardless of the direction of rotation of shaft 1061. The amount of friction (and hence the torque this mechanism can provide) is proportional to the number and tightness (torque) of the bolts 1004.

If the plates 1001 and 1041 are made of the same metal and have the same finish as washer 1022, then the washers 1011 and 1031 are likely to rotate at about half the speed of shaft 1061 and washer 1021. The friction is twice that of using a single washer. Additional friction can be obtained by adding another pair of washers like 1021 and 1031 to the right of washer 1031. Similarly, it is possible to eliminate one or both of washers 1011 and 1031 so that washer 1021 presses directly against plates 1001 and 1041. The preferred embodiment applies to any number of fixed and free washers and any number of fixed and floating plates in a configuration as shown in FIG. 10.

Further, it is possible to eliminate the key 1063. If the notch 1062 extends to the end of the shaft 1061, the rotating washer 1021 can have a protrusion that fits into notch 1062. This can make assembly easier, especially if there are multiple fixed and rotating sets of washers.

A suitable material for the plates 1001 and 1041 and for washer 1021 is steel. A suitable material for washers 1011 and 1031 is PTFE. However, the preferred embodiment is not limited to these materials or this combination of materials.

Figure 11:
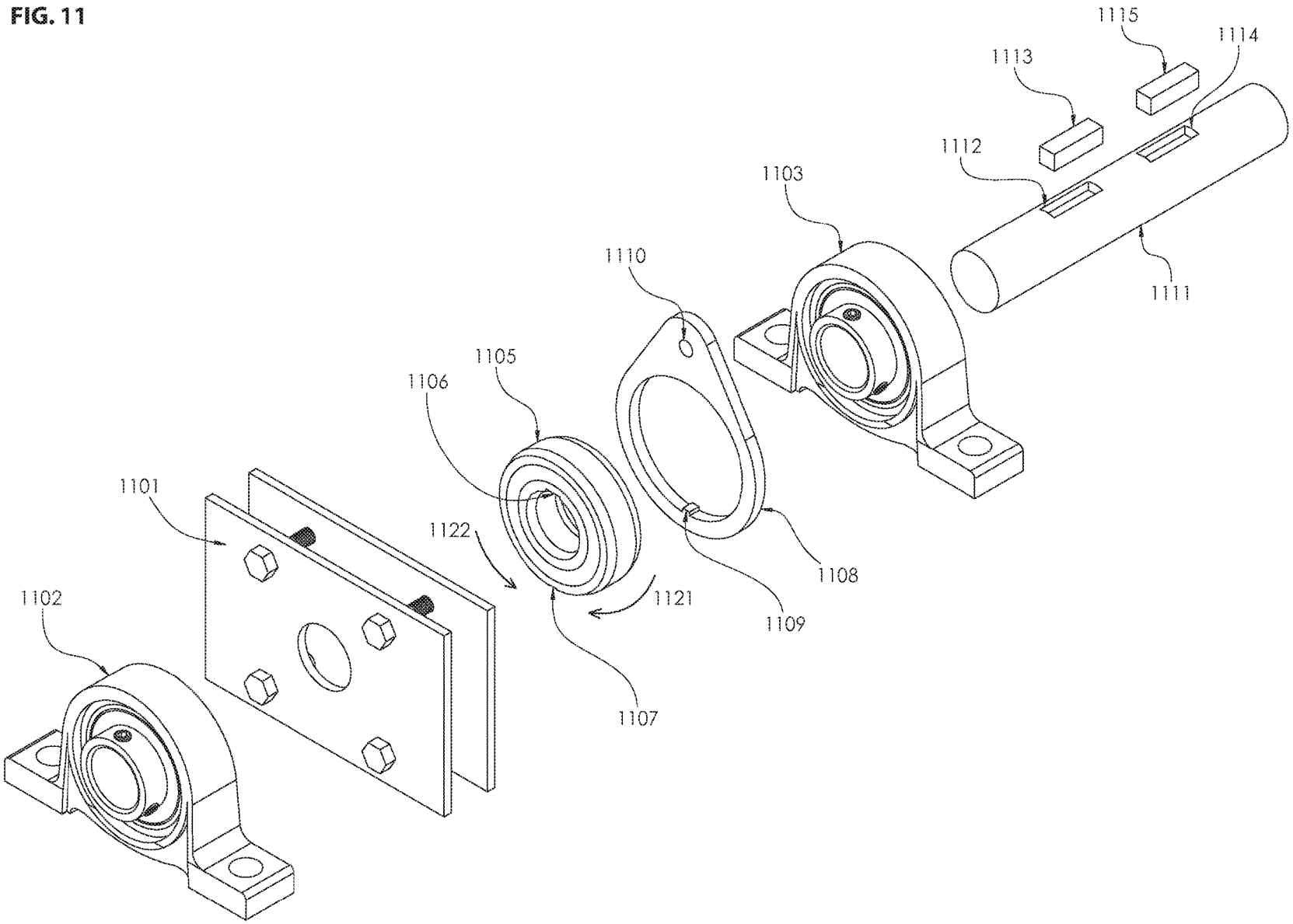

The friction mechanism described by FIG. 10 is shown as 1101 in FIG. 11. The shaft 1111 is that shown as 1061 in FIG. 10 and passes through the friction mechanism. The shaft 1111 is supported by bearings 1102 and 1103. The bearings 1102 and 1103 are regular bearings in that the shaft may rotate freely in either direction.

The bearings 1102 and 1103 are fixed to the same structure as the friction mechanism 1101. The bearings are shown in FIG. 11 as pillow block bearings but can be mounted in any manner, as long as they are supported so they do not move. One or both of the bearings could be bushings, or for a very low cost solution, the bearings can be replaced with holes in metal so that the shaft 1111 rotates about those holes. The term bearing in this section will be used to describe a bearing, bushing, or holes.

Further, the method of mounting the bearing is not material to the preferred embodiment, whether the bearings be welded, bolted, clamped, or restrained in some other way. Also, the two bearings can be mounted at one end of the shaft to restrain the shaft with the other end of the shaft free and unsupported. It is important that the bearings and the friction mechanism be mounted on the same structure.

The shaft 1111 has notch 1112 and key 1113 which serve the purpose of 1062 and 1063 respectively in FIG. 10 and as described above.

The bearing 1105 also fits over shaft 1111. The relative position of bearing 1105 and friction mechanism 1101 is not material to the preferred embodiment and their position on the shaft could be interchanged.

The bearing 1105 is a one way bearing. The bearing is installed such that when the inner part of the bearing is restrained, the outer part can rotate freely in the direction 1121 and will engage in the direction 1122. The one way bearing can be replaced by any freewheel mechanism described above.

The bearing 1105 has notch 1106 and the shaft 1111 has notch 1114. The key 1115 fits into notches 1114 and 1106. When the outer part of the one way bearing 1105 is rotated in the direction 1121, the shaft will not turn. When the outer part of the one way bearing 1105 is rotated in the direction 1122, the bearing engages and the shaft will turn.

The armature 1108 is fitted over the bearing 1105. The protrusion 1109 fits into the notch 1107 so that as armature 1108 rotates so too does the outer part of bearing 1105. The method of fixing the armature 1108 to the bearing 1105 is not material to the preferred embodiment. It could be welded, pressed in place, bolted, clamped, or held in some other manner.

When this assembly is complete, the armature 1108 can rotate freely in the direction 1121. The shaft does not turn. When the armature 1108 is rotated in the direction 1122, the bearing 1105 is locked and the shaft must turn. When the shaft turns, friction mechanism 1101 restricts the movement and a torque must be applied to armature 1108.

The hole 1110 is used for the link mechanism. Thus the armature 1108, hole 1110, and shaft 1111 correspond to armature 0806, hole 0808, and shaft 0805 as described for FIG. 8 above.

A.3.ii Second Method: Using Friction Mechanism Created by Armature Turning

Figure 12:
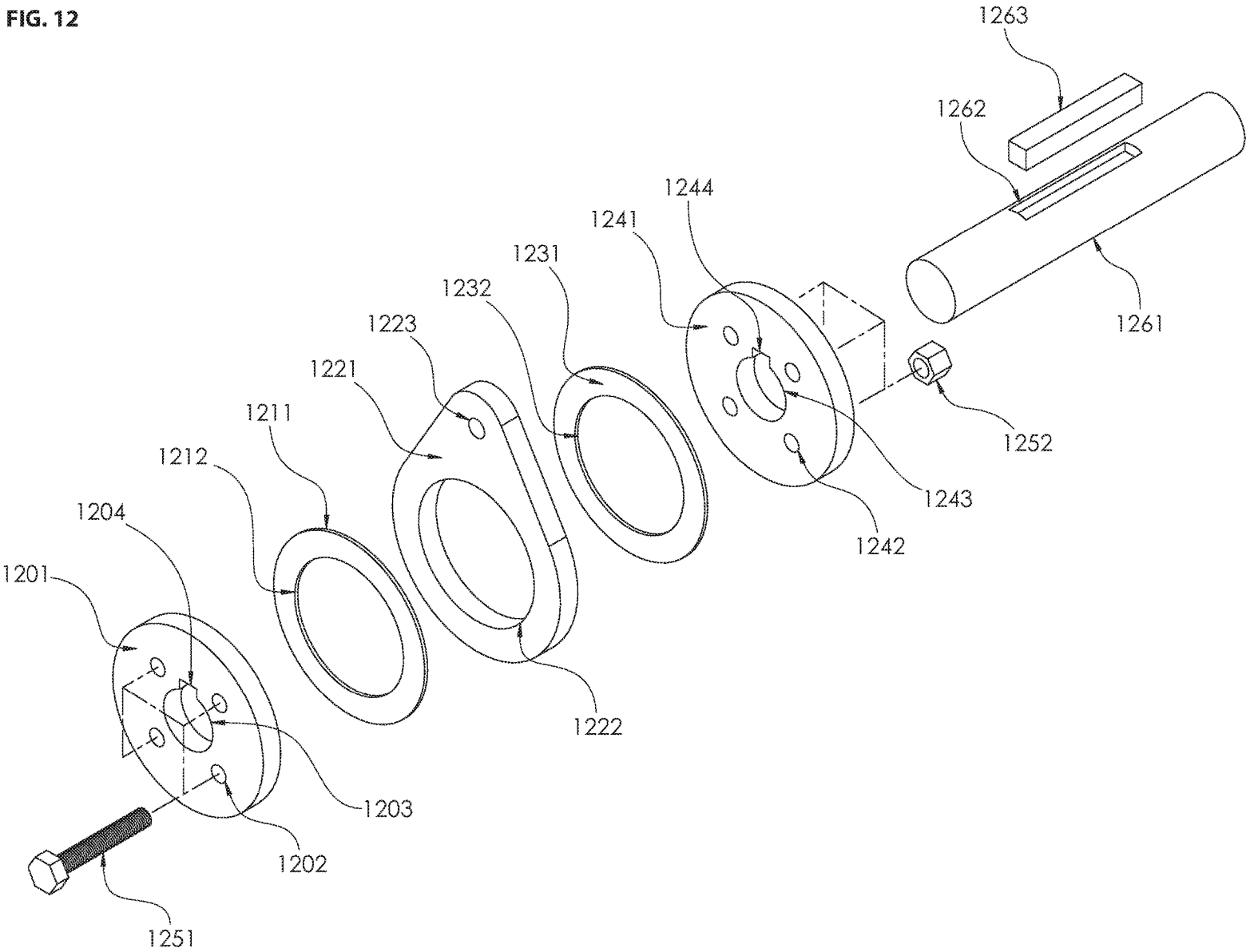
FIGS. 12-13 show exemplary friction generation through armature turning.

The friction mechanism is implemented as shown in FIG. 12.

The plates 1201 and 1241 may be identical. They have holes 1202 and 1242 through which pass bolts 1251. For clarity only one bolt is shown in FIG. 12. There may be any number of bolts, though in practice three to eight may be used.

The bolts 1251 hold plates 1201 and 1241 together by being fixed by nuts 1252. There may be washers and secondary nuts used as lock nuts but these are immaterial to the operation of the preferred embodiment.

Plates 1201 and 1241 have larger holes 1203 and 1243 through which shaft 1261 will fit. The plates 1201 and 1241 also have notches 1204 and 1244.

Between plates 1201 and 1241 are two washers 1211 and 1231 and armature 1221. These three parts have a large hole 1212, 1222, and 1232 respectively that fit on the outside of the bolts 1251.

Washers 1211 and 1231 would usually be made of the same material and can rotate about shaft 1261. Armature 1221 would be made of a hard material such as steel and can also rotate about shaft 1261.

When the shaft 1261 is in position, the key 1263 fits into notch 1262 and matches the notch 1204 on plate 1201 and the notch 1244 on plate 1241. When the shaft 1261 rotates, plates 1201 and 1241 rotate.

The bolts 1251 are fastened tightly with nuts 1252 so that when the shaft 1261 is fixed (that is, when it does not rotate) the armature 1221 creates friction against the surfaces of washers 1211 and 1231. These washers 1211 and 1231 will also try to rotate and create friction against plates 1201 and 1241 respectively. This friction is created regardless of the direction of rotation of armature 1221. The amount of friction (and hence the torque on the armature) is proportional to the number and tightness (torque) of the bolts 1251.

If the plates 1201 and 0141 are made of the same metal and have the same finish as armature 1221, then the washers 1211 and 1231 are likely to rotate at about half the speed armature 1221. The friction is twice that of using a single washer. Additional friction can be obtained by adding another washer and plate like 1231 and 1241 to the right of plate 1241 or by adding another armature and washer, with the multiple armatures being connected through hole 1223. Similarly, it is possible to eliminate one or both of washers 1211 and 1231 so that armature 1221 presses directly against plates 1201 and 1241. The preferred embodiment applies to any number of plates, washers, and armatures in a configuration as shown in FIG. 12.

A suitable material for the plates 1201 and 1241 and for armature 1221 is steel. A suitable material for washers 1211 and 1231 is PTFE. However, the preferred embodiment is not limited to these materials or this combination of materials.

Figure 13:
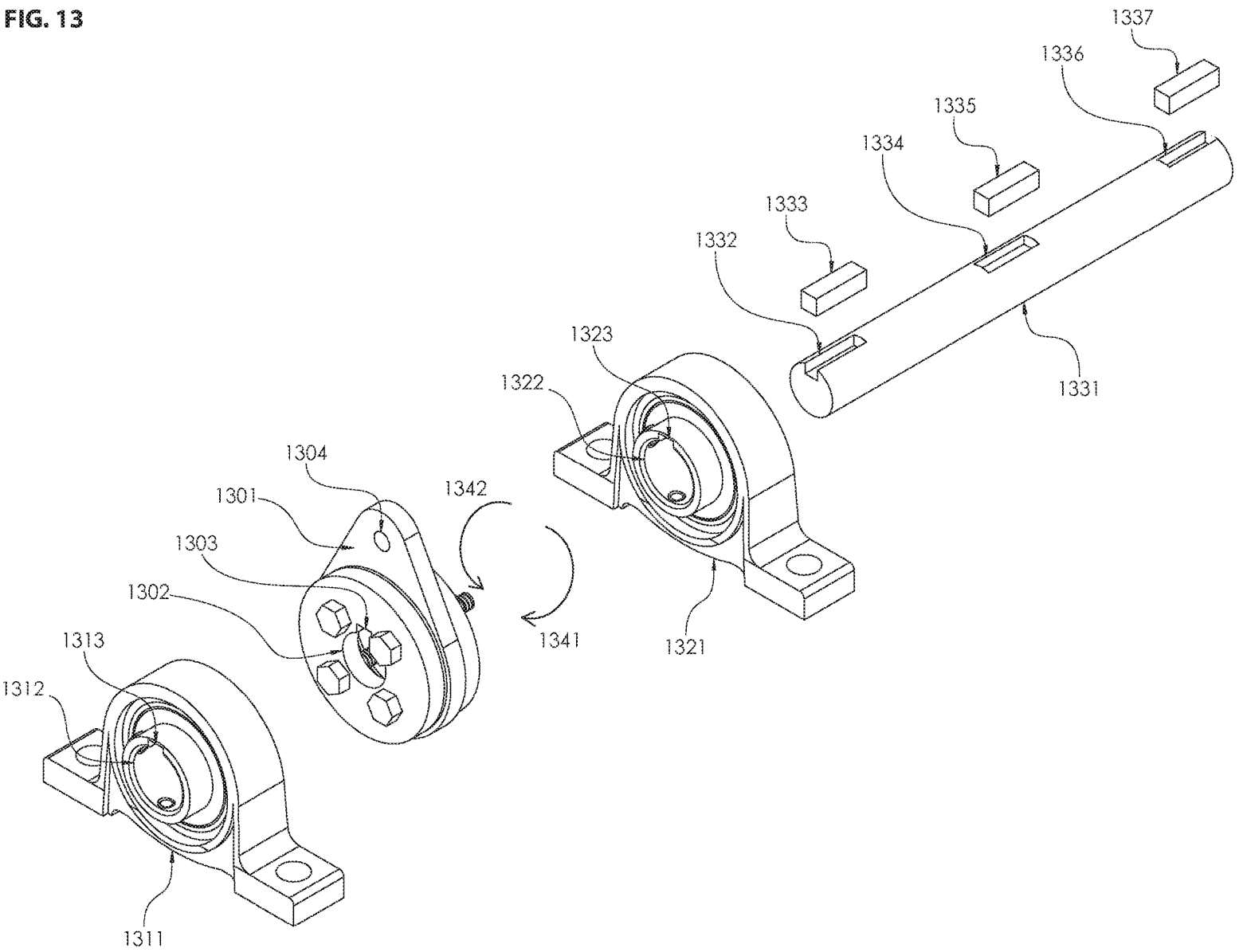

The friction mechanism described by FIG. 12 is shown as 1301 in FIG. 13. The shaft 1331 is that shown as 1261 in FIG. 12 and passes through the hole 1302 on the friction mechanism 1301. The shaft 1331 is supported by bearings 1311 and 1321.

One or both of the bearings 1311 and 1321 is a one way bearing. The bearing is (or the bearings are) installed so that they can rotate freely in the direction 1341 but are locked in the direction 1342.

The bearings 1311 and 1321 are fixed to the same structure as the top of the door cover. The bearings are shown in FIG. 13 as pillow block bearings but can be mounted in any manner, as long as they are supported so they do not move.

One of the bearings could be a bushing, or for a very low cost solution, one bearing can be replaced with holes in metal so that the shaft 1331 rotates about this hole. The term bearing in this section will be used to describe a bearing, bushing, or hole.

Further, the method of mounting the bearing is not material to the preferred embodiment, whether the bearings be welded, bolted, clamped, or restrained in some other way. Also, the two bearings can be mounted at one end of the shaft to restrain the shaft with the other end of the shaft free and unsupported.

The shaft 1331 has notches 1332, 1334, and 1336 where the keys 1333, 1335, and 1337 fit. Any or all of the notches may be combined and any or all of the keys may be combined. The key 1333 fits into notch 1313 on bearing 1311; the key 1335 fits into the notches 1303 on friction mechanism 1301; and the key 1337 fits into notch 1323 on bearing 1321.

The relative position of bearings 1311 and 1321 and friction mechanism 1301 is not material to the preferred embodiment and their positions on the shaft could be interchanged.

When this assembly is complete, the armature on the friction mechanism 1301 can rotate freely in the direction 1341. The shaft 1331 does not turn in the direction 1342, so for the armature of friction mechanism 1301 to move in that direction it encounters friction as explained in the description of FIG. 12. This provides the torque required in one direction but not in the other.

The hole 1304 is used for the link mechanism. Thus the armature on friction mechanism 1301, hole 1304, and shaft 1331 correspond to armature 0806, hole 0808, and shaft 0805 as described for FIG. 8 above.

B. Advantage of Counter Rotating Shafts

As explained above, the shaft for the torque mechanism (0805 in FIG. 8A) and the shaft for the door (0802 in FIG. 8A) rotate in opposite directions. FIG. 7 shows the effect of the torque being in the same direction as the movement of the door.

FIG. 14 shows the effect of the torque mechanism rotating in the opposite direction to that of the door.

FIG. 14A is similar to FIG. 7A. The door 1401 is connected to the hinge or shaft 1402. The hinge is mounted on the top panel 1411, 1412, and 1413. The part 1412 is the opening that the door 1401 covers. The door is closed in the direction 1408.

The shaft 1402 provides no resistance when the door is opened or closed. Therefore the issue shown in FIG. 7B and FIG. 7C does not arise.

The shaft 1402 is coupled to the hinge mechanism which is on shaft 1403. The linkage mechanism is not shown but would be as previously shown in FIG. 8. As the door 1401 closes in direction 1408, the shaft 1403 rotates in direction 1409 and provides torque to resist the motion. Point 1404 acts as a pivot point for this torque.

FIG. 14B shows an exaggerated view of the effect of closing the door. The top panel is represented by 1431, 1432, and 1433. The door 1421 is being closed by the application of force 1428. The force 1428 results in the torque 1429 about shaft 1423. Point 1424 acts as a pivot point so part of the panel 1431 and the shaft 1423 are raised. The door can be pushed below the horizontal, so that the angle 1425 (representing the angle of the door from the vertical position) is less than 90°.

FIG. 14C shows what happens when the door 1441 is no longer pushed closed and the force of 1428 in FIG. 14B is removed. The top panel 1451, 1452, and 1453 is restored to its original position. The hinge 1442 had been at an angle less than 90° but as the force on the door is released, the angle 1445 (representing the angle of the door from the vertical position) is forced to become 90° so the door remains fully closed.

In conclusion, the counter rotating shafts (of the pivot point of the door and that of the torque mechanism) aid in the ability to fully close the door. However, a single shaft (having the door and torque mechanism on the same pivot point) or two shafts (of the pivot point of the door and that of the torque mechanism) rotating in the same direction do not allow the door to fully close.

C. Addition of Springs to Lift Door

It is desired that the door be able to seal itself under its own weight. However, it should not be too heavy for a person to open. For example, if the weight door is 20 kg the force required to open the door (normal to the door) is about 100 N. This may be satisfactory if the door is at a person's waist height or lower, but is unsatisfactory if the door is at chest height or higher. In the latter case, a force of 30 N to 40 N is desired. This can be achieved by the addition of springs and three examples are shown in FIG. 15.

Figure 15A:
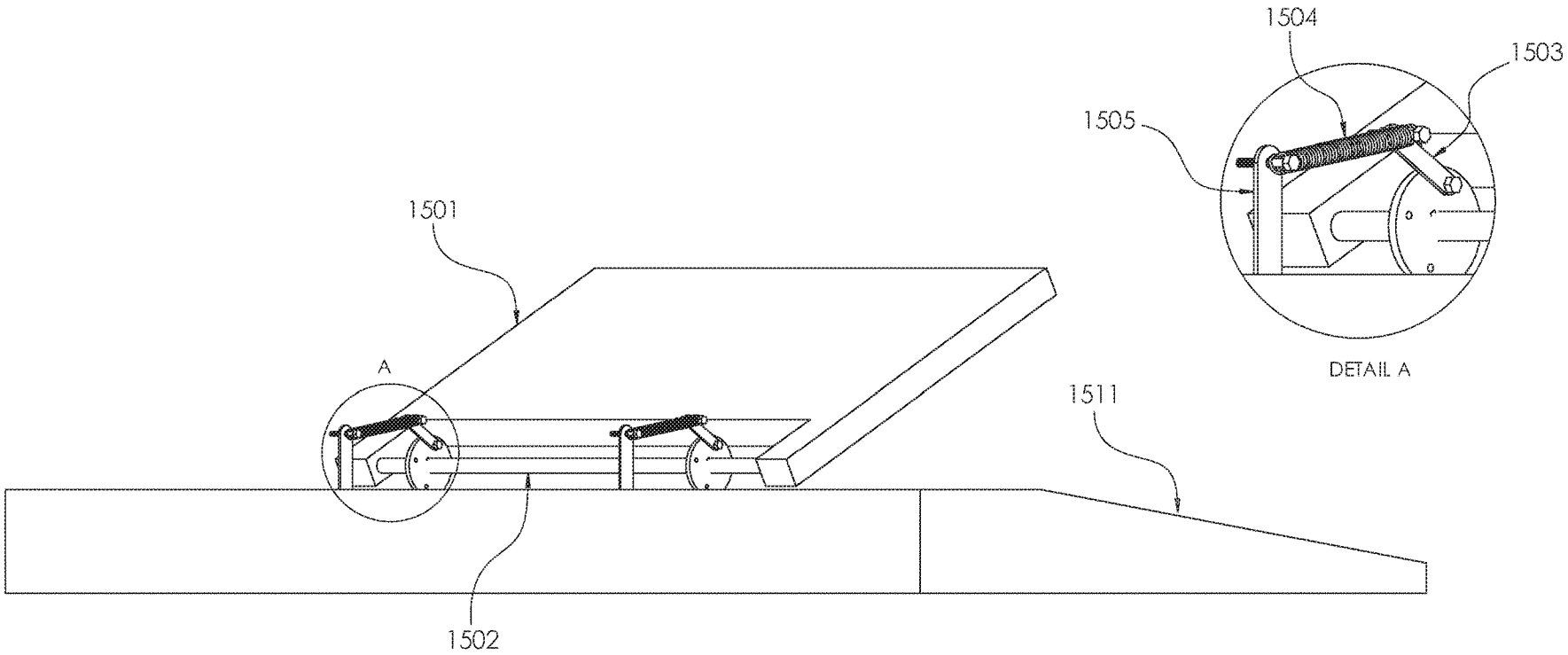
FIGS. 15A-15C show exemplary spring embodiments to lift door.

FIG. 15A shows the door 1501 rotating about shaft 1502 which is mounted on top panel 1511. An armature 1503 is either fixed to the door 1501 or the shaft 1502 and rotates with the door. An extension spring 1504 is connected between armature 1503 and block 1505. Block 1505 is mounted on top panel 1511. The spring is under tension (that is, it is extended) when the door is closed and provides force that aids a user to open the door.

In practice, it may be desirable to have one spring in the middle of shaft 1502 or multiple springs 1504 to ensure the force on the shaft (and hence on the opening of the door) is uniform. This may require multiple armatures 1503.

Figure 15B:
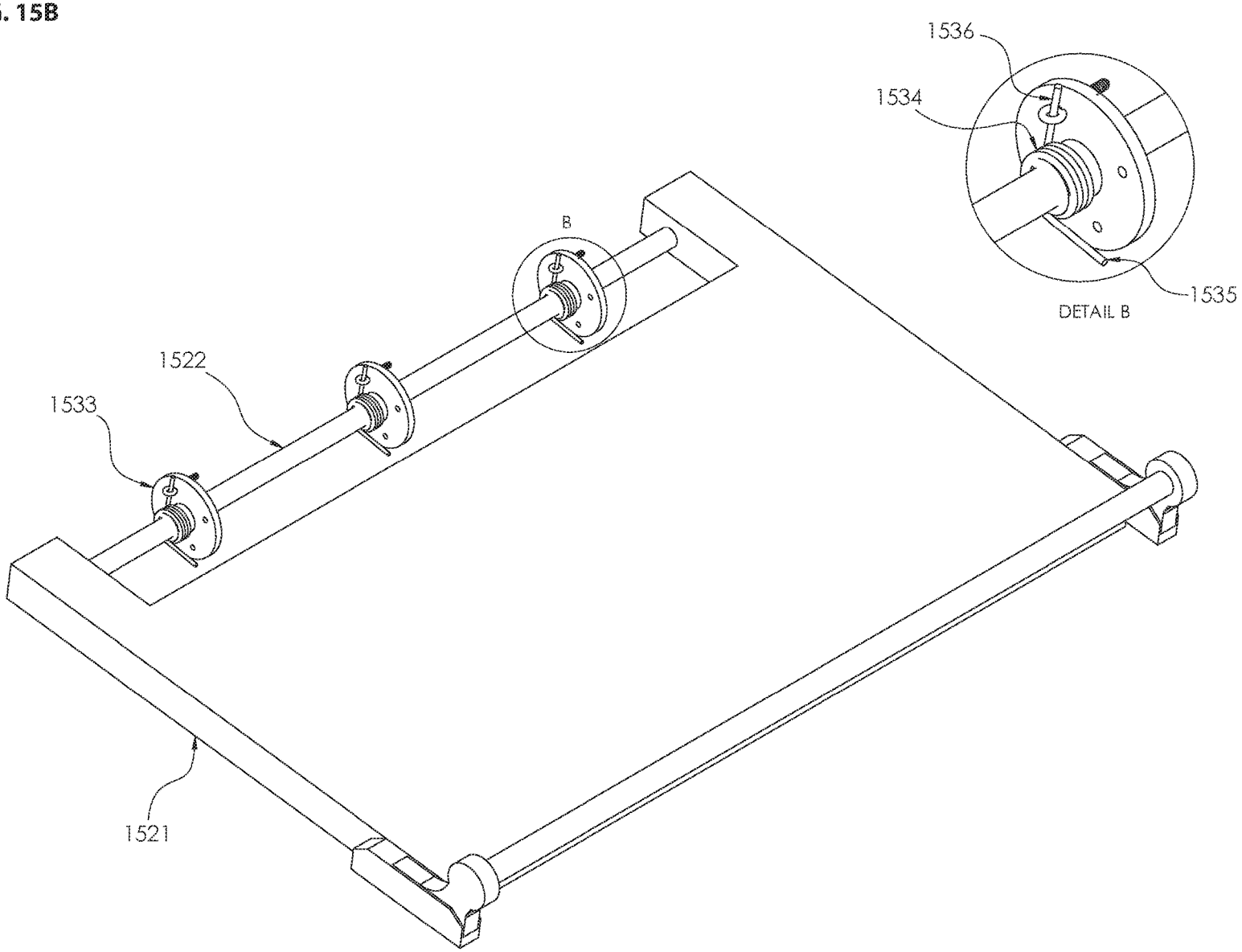

FIG. 15B shows the door 1521 rotating about shaft 1522. One or more armatures 1533 are fixed to the shaft 1522 and rotate with the shaft. One or more torsion springs 1534 are mounted over the shaft 1522. The torsion springs 1534 may be mounted over a collar or sleeve instead of directly over the shaft. One end of the torsion spring 1535 is resting on the top panel (not shown) or is fixed to an object that is itself mounted on the top panel. The other end of the torsion spring 1536 is mounted on armature 1533. The spring is under tension (that is, it is compressed) when the door is closed and provides force that aids a user to open the door.

Figure 15C:
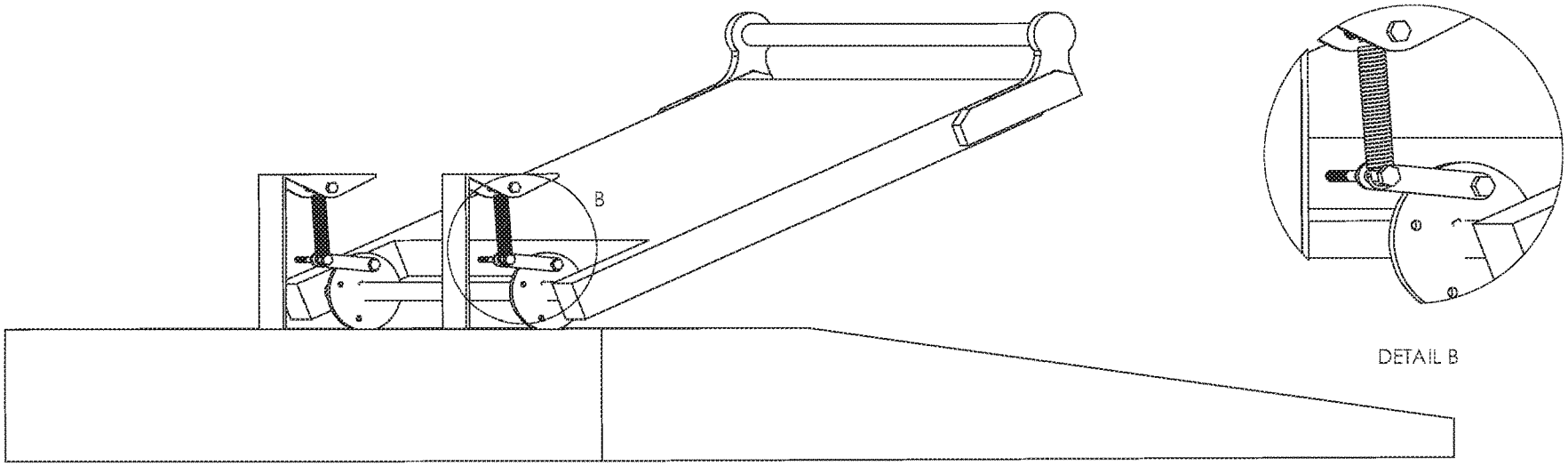

It would be possible to implement the preferred embodiment with a compression spring as shown in FIG. 15C. This presents difficulties in mounting the spring and is not discussed further.

D. Addition of Springs on the Torque Mechanism

With a heavy door, the amount of resistance required on the torque mechanism may generally necessitate the use of metal to metal for the washers of the torque mechanisms as PTFE may not provide the required friction. The friction created by the rubbing of metal against metal will cause wear on the mating faces. With the preferred embodiment, a typical amount of wear of 5 μm every 10,000 door openings is typical. This will reduce the pressure exerted by the bolts 1004 in FIGS. 10 and 1251 in FIG. 12. This results in a reduction of the friction of that torque mechanism and then allows the door to close at an angle greater than the initial angle 0604 shown in FIG. 6.

Conversely, if the door is opened often over a short period, the heat that is generated in the torque mechanism will raise the temperature of the elements between the plates (namely 1011, 1021, and 1031 in FIGS. 10 and 1211, 1221, and 1231 in FIG. 12). With the preferred embodiment, the rise in temperature can be 25 K resulting in an increase in thickness of about 4 μm. This will increase the pressure exerted by the bolts 1004 in FIGS. 10 and 1251 in FIG. 12. This results in an increase in the friction of that torque mechanism and then allows the door to close at an angle less than the initial angle 0604 shown in FIG. 6.

Figure 16A:
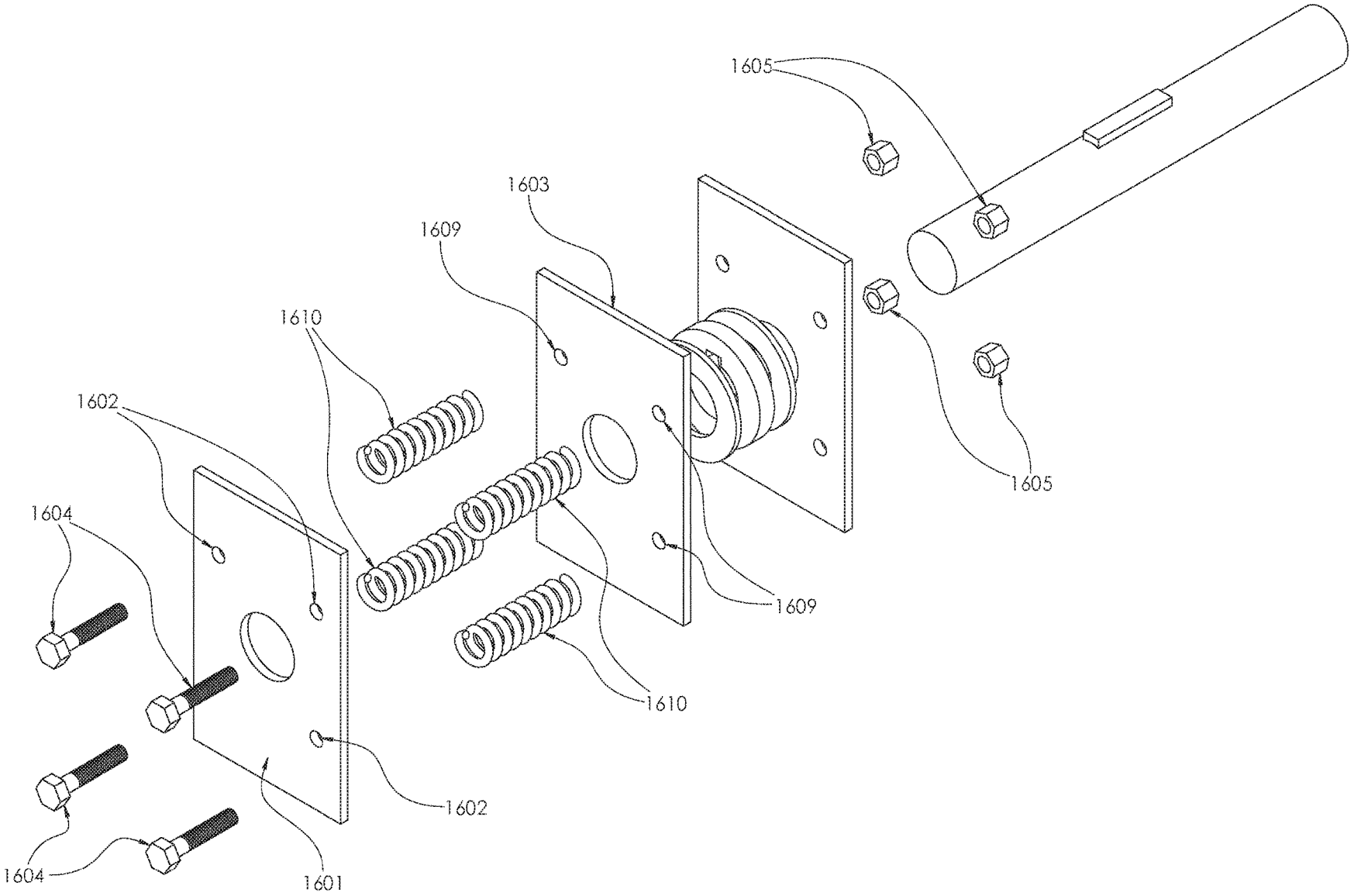
FIGS. 16A-16B show exemplary spring embodiments to reduce the impact of changes in size of the torque mechanism.

Each of these outcomes is undesirable. By adding springs as shown in FIG. 16 these problems are greatly reduced. FIGS. 16A and 168 show an adaptation of FIG. 10, but the use of springs applies equally to FIG. 12.

In FIG. 16A the plate 1603 corresponds to the plate 1001 in FIG. 10. Plate 1601 is additional to the components shown in FIG. 10. The bolts 1604 pass through plate 1601 and through the compression springs 1610. The bolts pass through the torque mechanism and are fixed with nuts 1605. In this FIG., the plate 1601 could be eliminated, but having it aids in stability. The nuts 1605 are adjusted to provide the same force on the torque mechanism as described in FIG. 10. Now, when the torque mechanisms expands or contracts, the force exerted by the springs changes to a negligible amount so the force on the torque mechanism (and hence the amount of torque) remains constant.

Figure 16B:
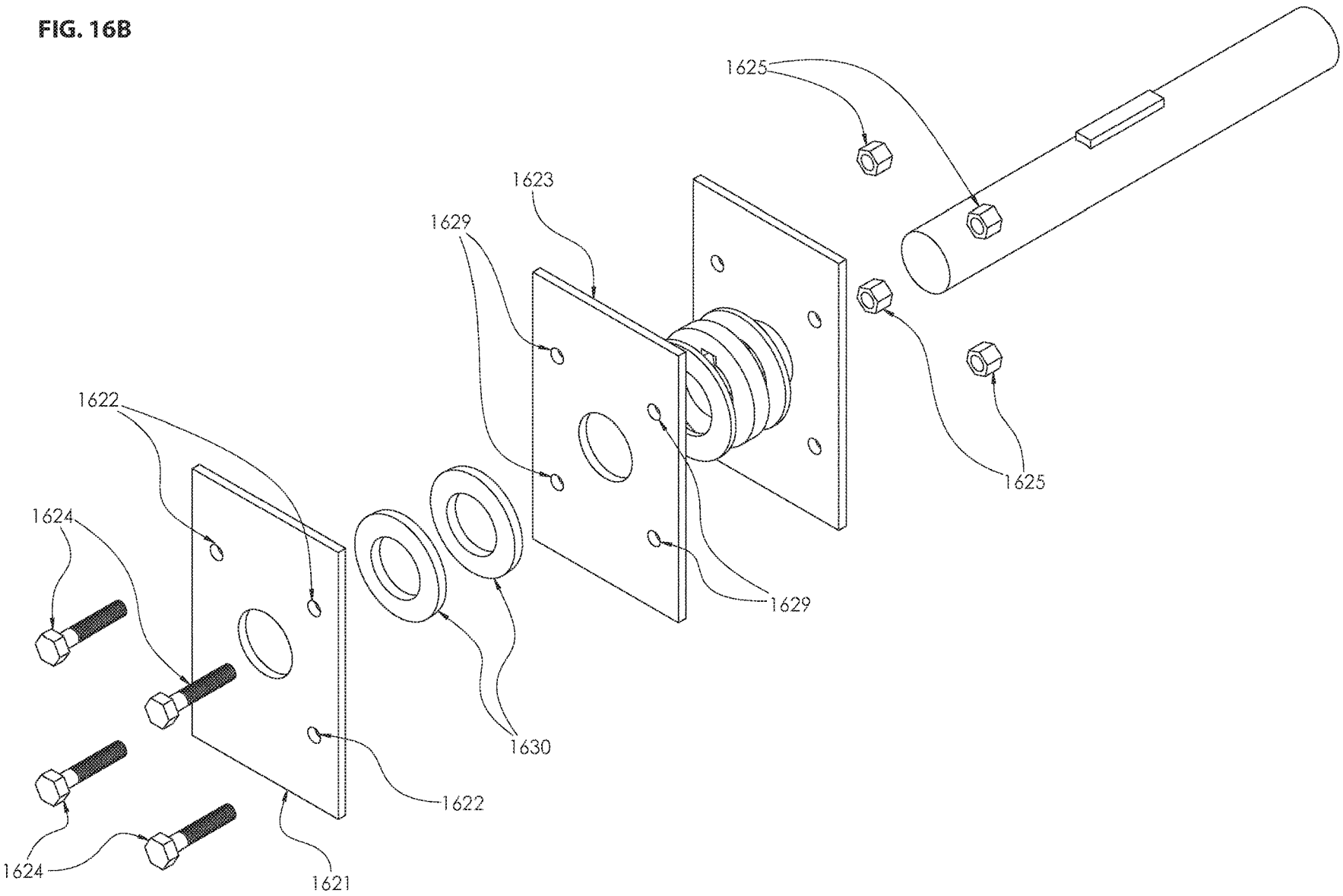

In FIG. 16B the plate 1623 corresponds to the plate 1001 in FIG. 10. Plate 1621 is additional to the components shown in FIG. 10. The bolts 1624 pass through plate 1621 and through the spring washers 1630. These spring washers are sometimes called Belleville springs. The bolts pass through the torque mechanism and are fixed with nuts 1625. In this FIG., the plate 1621 cannot be eliminated. The nuts 1625 are adjusted to provide the same force on the torque mechanism as described in FIG. 10. Now, when the torque mechanisms expands or contracts, the force exerted by the springs changes to a negligible amount so the force on the torque mechanism (and hence the amount of torque) remains constant.

E. Door Switch

It is often required to know when the door is closed or just open. This may be needed as a safety requirement if the door opens to reveal machinery that may be moving. Two examples of how this may be accomplished are shown in FIG. 17.

Figure 17A:
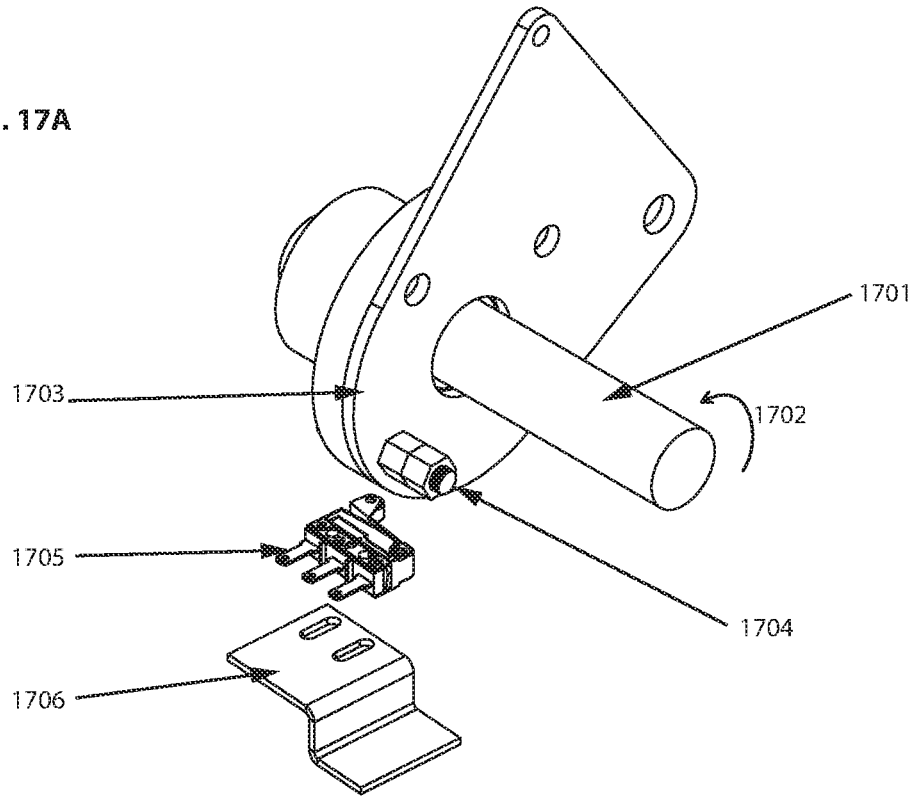
FIGS. 17A-17B show exemplary switch arrangements to detect a door open position.

In FIG. 17A, the shaft 1701 may be the door shaft or the torque shaft (that is, it may be 0802 or 0805 in FIG. 8). The shaft 1701 rotates in the direction 1702 as the door opens. A cam or armature 1703 is fixed to shaft 1701 and has a protrusion 1704 (shown as nuts). A switch 1705 is mounted on a fixed plate 1706. When the door is closed the protrusion 1704 activates switch 1705 and as the door opens, the protrusion changes the state of switch 1705.

Figure 17B:
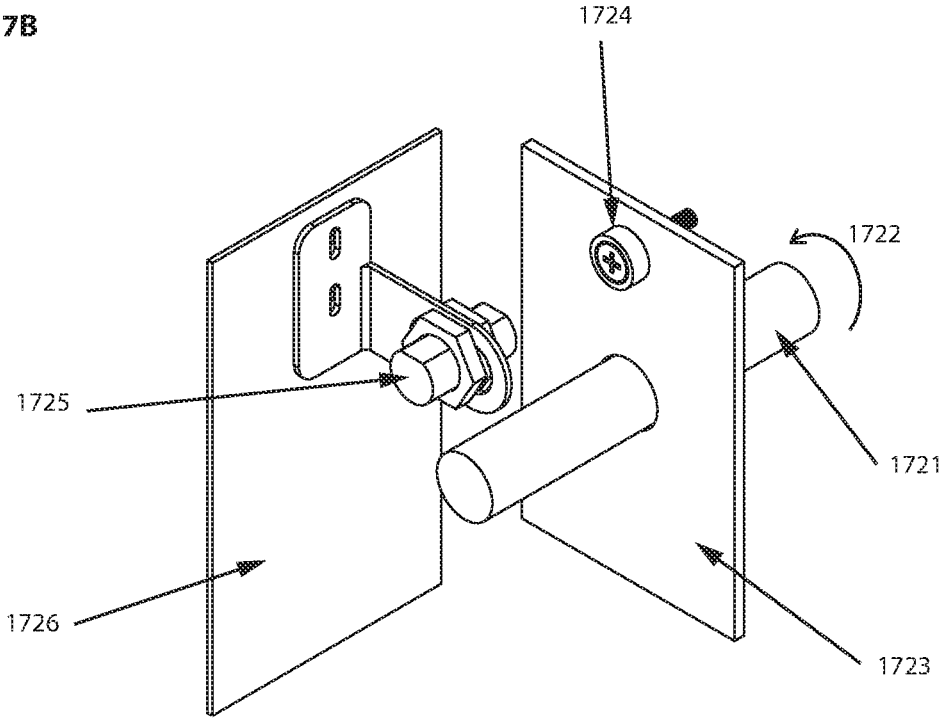

In FIG. 17B, the shaft 1721 may be the door shaft or the torque shaft (that is, it may be 0802 or 0805 in FIG. 8). The shaft 1721 rotates in the direction 1722 as the door opens. A cam or armature 1723 is fixed to shaft 1721 and has a magnet 1724. An electronic hall effect switch 1725 is mounted on a fixed plate 1726. When the door is closed the magnet 1724 activates switch 1725 and as the door opens, the magnet changes the state of switch 1725.

With either of FIG. 17A or 17B adjustments can be made easily so that the state of the switch changes when the door is opened a few mm or when it is opened a greater amount.

F. Best Practices

It is advisable to make all components from stainless steel to prevent rusting and premature failure. Plain steel can be used in low cost applications or where it is known that the environment is dry.

The torque mechanism described in A.3.ii is preferred over that described in A.3.i when the door is light for the following reasons:

- The bolts and nuts holding the torque mechanism shown as 1004 and 1051 in FIG. 10 are fixed in place. If the whole assembly is being made in a small space, access to the bolts that lie at the back and bottom of the torque assembly are hard to reach. It is therefore difficult to adjust the torque.
- With the torque mechanism described in A.3.ii, every time the door is opened and closed, the torque mechanism rotates. Therefore, the bolts 1251 shown in FIG. 12 are presented one after another to a point that is accessible to they can be adjusted.
- The length of the key 1063 in FIG. 10 should be no wider than that of the washer 1021. However the length of the key 1263 in FIG. 12 can be longer than the width of the components that comprise the torque mechanism. In other words, precision is less important.
- The method of A.3.i uses a single one way bearing but the method of A.3.ii uses two such bearings. While either method can be easily expanded to increase the number of such bearings, the method of A.3.ii has the initial advantage. The bearings must be chosen such that their torque rating is greater than that required of the torque mechanism. Having two bearings doubles their combined torque rating.

The washers 1211 and 1231 can be made of PTFE for doors that are light (under 3 kg). This provides a quiet torque mechanism. However, for heavier doors, the force required by the bolts 1251 exceeds the rated pressure on PTFE. Suitable materials for these washers for heavier doors include brass or steel. Because of the phenomenon called stick-slip, metal to metal used for the friction can be noisy. Brass to steel provides a lower coefficient of friction than steel to steel, but is quieter. Lead to steel is better because the static and kinetic coefficients of friction are nearly equal. Unfortunately, lead has environmental problems and is best avoided.

If the door is heavy, then the mechanism described in A.3.i is preferred over that described in A.3.ii for the following reasons:

- The armature 1221 in FIG. 12 runs over the bolts 1251. With a heavy door there is significant force that causes friction of the armature against the bolts that may be greater than that of the armature against the washers 1211 and 1231. This may be overcome with a sleeve over the bolts but that introduces more complexity.

The friction mechanism is always connected to the link mechanism and cannot easily be repositioned.

The bearing 1105 and armature 1108 in FIG. 11 can be duplicated side by side to give extra strength and balance for the link mechanism.

The friction mechanism can be placed outside the bearings at the end of the shaft. This permits simpler assembly because it can be installed after the shaft is installed on the bearings and it allows room to get spanners on the nuts and bolts without the shaft restricting access.

If minor lubrication is used to reduce the noise created by stick-slip then brass to steel is preferred. The noise can also be reduced by polishing all components without significantly affecting the amount of torque. However, oils are easily squeezed out because of the very high pressures involved and are generally ineffective. If steel to steel is used, the washers 1211 and 1231 (in FIG. 12) can be eliminated. The travel of armature 1221 over plates 1201 and 1241 is increased by doing so and this helps to reduce the noise due to stick-slip.

The extension spring (shown in FIG. 15A) is preferred for doors that weigh over 12 kg because it is easier to get springs of the required strength. Torsion springs (shown in 15B) are suitable for lighter doors. However, a torsion spring provides a nearly constant torque on the door shaft so the curve 0602 in FIG. 6 is hard to obtain. By adjusting the relative position of armature 1503 shown in FIG. 15A, the torque exerted by the extension spring 1504 will change as the door is opened. This, balanced with the effect of the weight of the door about the shaft 1502 will help to achieve the curve of 0602 in FIG. 6.

While the above door closing and opening system can be used in many applications, one exemplary use is to add and secure the content of a waste food machine. For any type of such machine (wet, dry, or hybrid), the machine normally runs only when the door or doors are closed. For a wet type of machine, the door may be opened at any time so that additional waste food or additives can be added. For a dry type of machine, the methodology is a batch process, so once the process is started the door is kept closed and typically no further waste food can be added until the process is complete.

Figure 18:
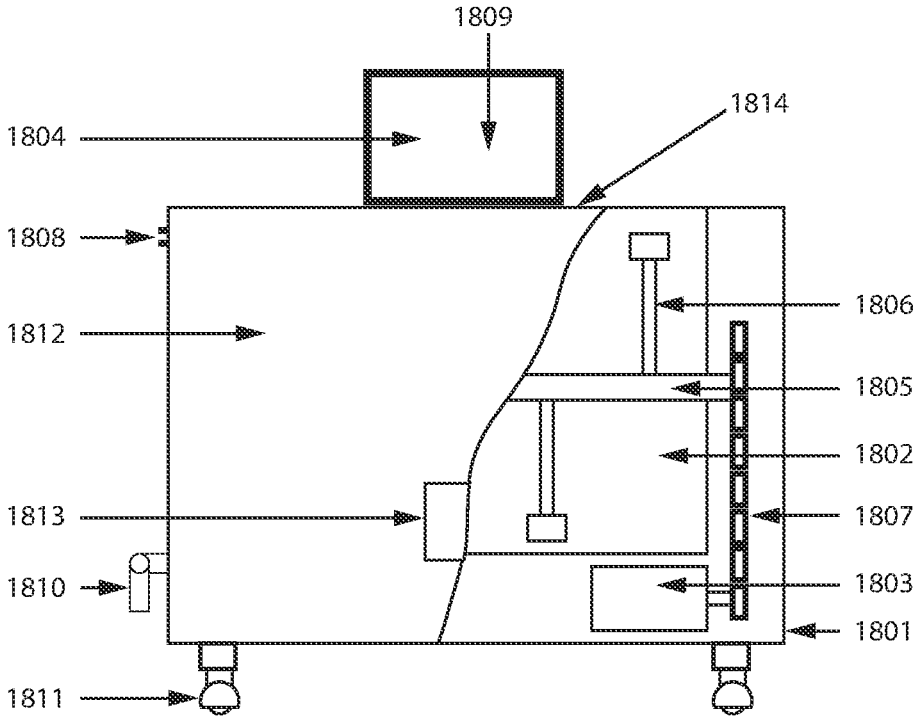
FIG. 18 shows an exemplary waste food processor where the door is used.

FIG. 18 is a partially cut away side view of an exemplary waste food machine, in accordance with the prior art. Waste food machines may vary in size, with typical industrial machines digesting from 20 kg per day to 3000 kg per day. Such devices may vary from about 50 cm wide to 400 cm wide. Many such machines are constructed mostly of stainless steel.

For a wet type of machine and referring to FIG. 18, a chassis 1801 supports a drum 1802 and a motor 1803. In general, waste food is put into drum 1802 through a door 1804. Motor 1803 drives a shaft 1805 with arms 1806 through a chain, belt, or system of gears 1807. Motor 1803 causes arms 1806 to rotate slowly (for example at about one revolution every five to 12 seconds) to mix old waste food with new waste food. Water may be added through an inlet 1808 to maintain the correct moisture content in drum 1802 for the decomposition process. The decomposition of the waste food may be accelerated by the addition of microorganisms, enzymes, or a blend of microorganisms and enzymes 1809 that are added periodically to drum 1802 either automatically by additive releasing means or manually through door 1804. In a typical machine, digested material exits the drum 1802 through a pipe 1810 and thereby the digested liquid and tiny particles may flow out of the machine to a drain. Chassis 1801 is often supported on supports 1811, of which there are typically four. In some machines, these supports may be combined with wheels to allow the machine to be moveable or the wheels may be separate. The supports may be the feet of load cells that allow the machine to weigh the waste food. An outer casing 1812 is usually made of stainless steel.

For a dry type of machine, the structure is similar to the wet type. However, water and microorganisms are not typically added to the machine. Usually, the machine is loaded with waste food, the door is closed, and the machine heats the waste food. Typically, the temperature is raised to 90° C. for six to 10 hours and a cycle takes about 18 hours. The machine may churn the waste during this process with the objective of breaking it into small pieces. At the end of the cycle, the dehydrated waste is emptied through an output door 1813, which is typically not present on the wet type of machine. The dehydrated waste is typically 5% to 10% of the original volume of waste food.

A hybrid type machine may start with a decomposition process similar to a wet type of machine, and, after a certain time, for example, 12 hours, the machine may then dry the remainder of the waste food similar to a dry type of machine.

With the typical waste food machine, the door may be 10 to 25 kg and the height of the door, especially on machines that can process more than 100 kg of waste per day, is above the waist of an average person. It is desirable that the door is easy to open and it is essential that it should remain open so that the operator can put the waste food into the machine.

As a person adds waste food to the machine, invariably some of it will spill onto the top panel 1814 of the machine. That is, the waste food may spill either side of the door. The operator needs to clean this to avoid unhygienic conditions and having gas struts, catches, latches, and other such items in the way makes that job harder.

When the operator closes the door, it should close completely and remain in place under its own weight. In the case of a wet type of waste food machine, the door seals against the top panel to retain heat and moisture inside the drum. If the door remained open just a few mm the rate of digestion of the waste food will be affected.

It can therefore be seen that the present invention satisfies the requirements for a waste food machine very well. The door: is easy to open; stays open; is easy to close; shuts completely; remains shut to seal the drum.

While various methods, configurations, and features of the present invention have been described above and shown in the drawings, one of ordinary skill in the art will appreciate from this disclosure that any combination of the above features can be used without departing from the scope of the present invention. It is also recognized by those skilled in the art that changes may be made to the above described methods and embodiments without departing from the broad inventive concept thereof.

What is claimed is:

1. A system, comprising:

a first shaft coupled to a door for rotating the door;

a first armature on the first shaft;

a second shaft with a module that resists motion;

a second armature on the second shaft;

wherein the first and second armatures rotate in opposite directions;

a linkage that connects the first armature at a first connection point spaced from the first shaft with the second armature at a second connection point spaced from the second shaft;

a freewheel connecting the second armature and the second shaft such that the module that resists motion is not engaged in an opening direction, thereby allowing the opening of the door without resistance;

the freewheel engaging the module that resists motion as the door is closed to provide resistance as the door is closed; and the linkage positioned such that as the door is nearly closed, the first shaft, the second shaft, and the first connection point are aligned, such that the module that resists motion is no longer engaged and the resistance becomes negligible allowing the door to close fully.

2. The system of claim 1, wherein the second armature moves with minimum resistance as the door is opened.

3. The system of claim 2 wherein the second armature moves with resistance as the door is closed.

4. The system of claim 1, wherein the first armature and the linkage are aligned to minimize friction when the door is nearly closed.

5. The system of claim 1, wherein the module that resists motion is a friction or damping unit coupled to the freewheel.

6. The system of claim 5, wherein the freewheel comprises at least a ratchet, a one-way bearing, or an overrunning clutch.

7. The system of claim 1, wherein the door provides a tight seal based on the weight of the door.

* * * * *